US010400739B2

(12) United States Patent
Forte et al.

(10) Patent No.: US 10,400,739 B2
(45) Date of Patent: Sep. 3, 2019

(54) ELECTRONIC IGNITION SYSTEM FOR AN INTERNAL COMBUSTION ENGINE

(71) Applicant: ELDOR CORPORATION S.P.A., Orsenigo (como) (IT)

(72) Inventors: Pasquale Forte, Orsenigo (IT); Stefano Silva, Orsenigo (IT); Eugenio Carugati, Orsenigo (IT); Davide Failla, Orsenigo (IT)

(73) Assignee: Eldor Corporation S.P.A., Orsenigo (Como) (IT)

( * ) Notice: Subject to any disclaimer, the term of this patent is extended or adjusted under 35 U.S.C. 154(b) by 0 days.

(21) Appl. No.: 15/574,077

(22) PCT Filed: Apr. 21, 2016

(86) PCT No.: PCT/IB2016/052258

§ 371 (c)(1),
(2) Date: Nov. 14, 2017

(87) PCT Pub. No.: WO2016/181242

PCT Pub. Date: Nov. 17, 2016

(65) Prior Publication Data

US 2018/0298872 A1 Oct. 18, 2018

(30) Foreign Application Priority Data

May 14, 2015 (IT) ..... MI2015A0680

(51) Int. Cl.
*F02P 17/12* (2006.01)
*F02P 3/04* (2006.01)
*F02D 35/02* (2006.01)

(52) U.S. Cl.
CPC ..... *F02P 17/12* (2013.01); *F02D 35/021* (2013.01); *F02P 3/0442* (2013.01); *F02P 2017/125* (2013.01); *F02P 2017/128* (2013.01)

(58) Field of Classification Search
CPC ..... F02P 17/12; F02P 3/0442; F02P 2017/128
See application file for complete search history.

(56) References Cited

U.S. PATENT DOCUMENTS 4,218,915 A * 8/1980 Torimaru ..... G01F 1/60 73/861.16
4,359,893 A * 11/1982 Kizler ..... F02P 17/12 324/460

(Continued)

FOREIGN PATENT DOCUMENTS

DE 19849258 4/2000
EP 1316723 6/2003
WO WO 2016181242 A1 * 11/2016 ..... F02P 3/0442

OTHER PUBLICATIONS 201680027655.5, Jun. 4, 2018, Chinese Office Action with English Translation.

(Continued)

*Primary Examiner* — Joseph J Dallo
(74) *Attorney, Agent, or Firm* — Workman Nydegger

(57) ABSTRACT

An electronic ignition system for an internal combustion engine. The system includes a coil having a primary winding with a first terminal and a second terminal and a secondary winding connected to a spark plug. A high voltage switch is serially connected to the primary winding. A control terminal carries a control signal to control the opening or closing of the high voltage switch. A first switch is interposed between a battery voltage and the first terminal of the primary winding, a second switch is interposed between the first terminal of the primary winding and a reference voltage, a third switch is interposed between the second terminal of the primary winding and said reference voltage. A driving unit is configured to generate signals to control the switches (Continued)

during a charging phase, during a transfer of energy phase, and during a measure phase of ionization current.

11 Claims, 6 Drawing Sheets

(56) References Cited

U.S. PATENT DOCUMENTS 4,641,626 A 2/1987 Morino et al.
4,738,239 A * 4/1988 Haines ..... F02P 3/0435 123/630
5,056,496 A * 10/1991 Morino ..... F02P 3/0884 123/604
5,821,754 A * 10/1998 Puettmann ..... F02P 17/12 324/388
6,116,226 A * 9/2000 Vogel ..... F02P 17/12 123/609
6,123,057 A * 9/2000 Goras ..... F02P 3/0456 123/406.2
6,424,155 B1 * 7/2002 Puettmann ..... F02P 17/12 324/388
6,653,840 B2 * 11/2003 Yorita ..... F02P 17/12 324/380
2002/0050823 A1 * 5/2002 Puettmann ..... F02P 17/12 324/388
2002/0145429 A1 * 10/2002 Yorita ..... F02P 17/12 324/380
2003/0089355 A1 5/2003 Vogel et al.
2003/0116148 A1 6/2003 Sakakura
2011/0016952 A1 * 1/2011 Heinzelmann ..... F02D 35/027 73/35.08

OTHER PUBLICATIONS

PTC/IB2016/052258, Aug. 2, 2016, International Search Report / Written Opinion.

* cited by examiner

ELECTRONIC IGNITION SYSTEM FOR AN INTERNAL COMBUSTION ENGINE

BACKGROUND

Technical Field

The present disclosure generally relates to an electronic ignition system for an internal combustion engine, such as for example the engine of a motor vehicle.

More in particular, the present disclosure relates to an electronic ignition system performing the reading of the ionization current in order to measure parameters representative of the combustion process of the mixture air-fuel internally of a cylinder of the engine.

Description of the Related Art

Modern internal combustion engines for motor vehicles are equipped with systems for analyzing the internal combustion process, in order to maximize the efficiency and the performance of the engine itself.

It is known the measurement of the ionization current for obtaining information indicative of parameters of the combustion process of the mixture air-fuel directly from the combustion chamber.

In particular, the spark plug is used as an ion sensor (typically of type $CHO^+$, $H_3O^+$, $C_3H_3^+$, $NO_2^+$) which are generated in the combustion chamber after the spark between the electrodes of the spark plug has been generated and the combustion of the mixture air-fuel has taken place.

Therefore the ionization current is generated by applying a potential difference to the electrodes of the spark plug and by measuring the current generated by means of the ions produced in the combustion chamber.

By means of the measurement of the ionization current it is possible to detect the presence of oscillations of the pressure value internally of the combustion chamber (known as "knocking" vibrations), which can damage the engine head: therefore it is necessary to detect said oscillations in real time and perform timely suitable actions for preventing engine damage.

The reading path of the ionization current has a high value of impedance due to the presence of the inductance of the secondary winding which has a very high value: this makes the reading of the value of the ionization current difficult, because its amplitude value is very small.

US patent publication no. 2002/0050823-A1 discloses an ignition system having a device for measuring the ionization current.

The ignition system comprises a switch (see S1 in FIG. 1) which has the function to short-circuit each other the two terminals of the primary winding L1, during the time length of the measurement of the ionization current.

The Applicant has observed that this prior art has the following disadvantages:

- the diode of MOSFET S1 enters into conduction during the operation of the coil 1, thus preventing the correct operation thereof;
- the time taken for setting to zero the value of the current through the secondary winding can be too high, thus causing a delay in detecting the "knocking" vibrations;
- if a plurality of spark plugs are present (typically there are four), it is required a switch for each coil connected to the respective spark plug.

BRIEF SUMMARY

The present disclosure relates to an electronic ignition system for an internal combustion engine as defined in the enclosed claim 1 and its preferred embodiments disclosed in the dependent claims 2 to 8.

The Applicant has perceived that the electronic ignition system according to the present disclosure has the following advantages:

- it effectively and reliably reduces the inductance of the secondary winding during the phase of reading the ionization current, thus improving the amplitude of the signal that is usable for reading the ionization current;
- it allows to shift upwardly the frequency limit of the dynamic of the secondary winding;
- it allows to dissipate the residual energy on the secondary winding at the end of the generation of the spark, thus reducing the noises at the end of the generation of the spark and improving the reading of the ionization current;
- it reduces the time required for setting to zero the value of the current through the secondary winding and for measuring the ionization current, thus allowing a ready detection of the presence of "knocking" vibrations;
- it reduces the number of used electronic components in case that more than one spark plug is present.

One embodiment of the present disclosure is an electronic device to control a coil as defined in the enclosed claim 9.

Another embodiment of the present disclosure is a method for controlling the electronic ignition of an internal combustion engine as defined in the enclosed claim 10.

Another embodiment of the present disclosure is a computer program product as defined in the enclosed claim 11.

BRIEF DESCRIPTION OF THE SEVERAL VIEWS OF THE DRAWINGS

Further characteristics and advantages of the disclosure will become more apparent from the description which follows of a preferred embodiment and the variants thereof, provided by way of example in the encloses drawings, wherein.

DETAILED DESCRIPTION

Figure 1A:
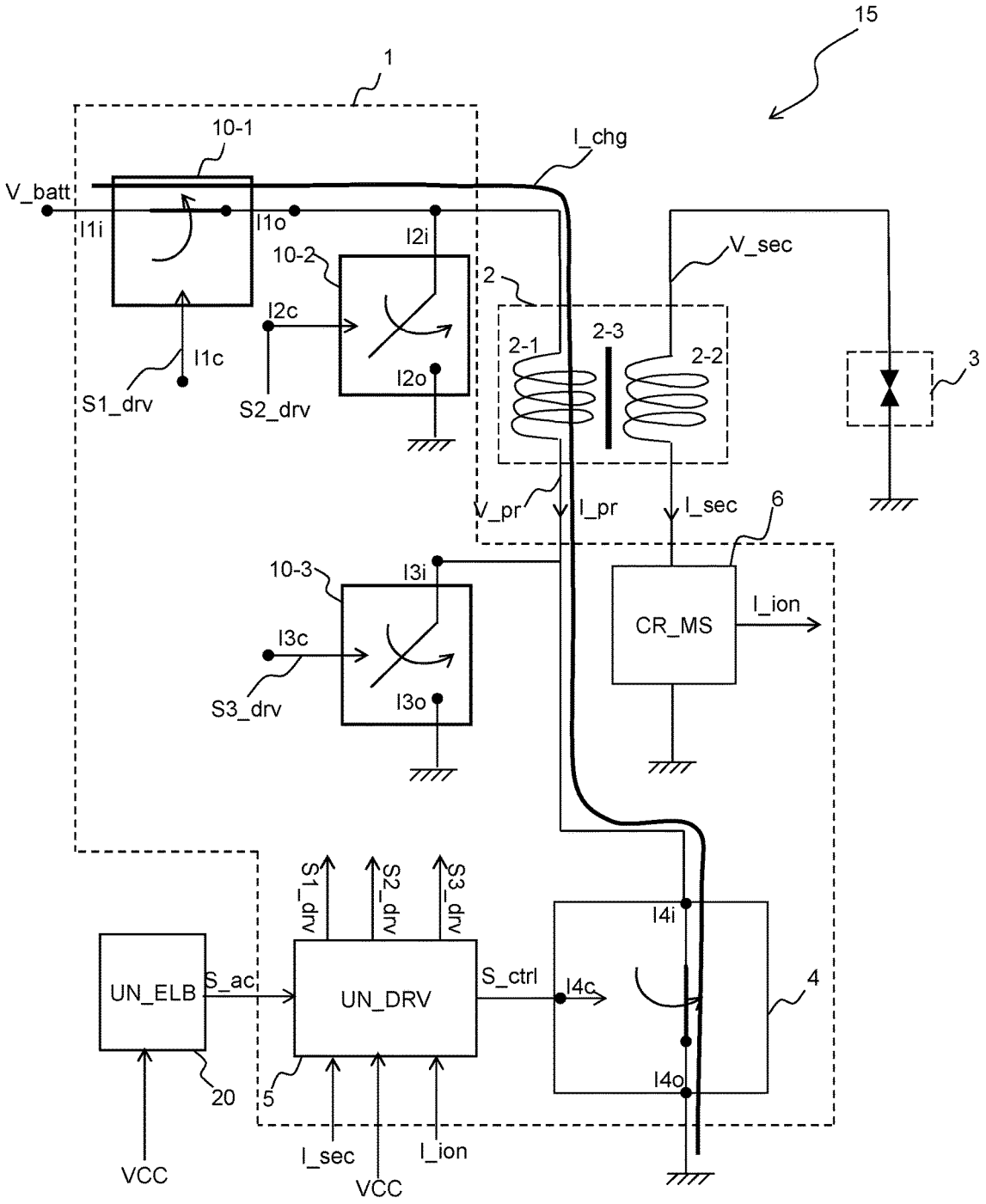
FIG. 1A schematically shows an electronic ignition system for an internal combustion engine according to one embodiment of the disclosure, during the charging phase of energy into the primary winding.

It should be observed that in the following description, identical or analogous blocks, components or modules are indicated in the figures with the same numerical references, even if they are illustrated in different embodiments of the disclosure.

With reference to FIG. 1, it shows an electronic ignition system 15 for an internal combustion engine according to the embodiment of the disclosure.

The electronic ignition system 15 can be mounted on any motor vehicle, such as for example a car, a motorcycle or a truck.

The ignition system 15 comprises:

an ignition coil 2;

a spark plug 3;

a control device 1;

a processing unit 20.

The processing unit 20 is positioned sufficiently far from the head of the internal combustion engine, so as not to be affected by the high working temperature of the ignition coil 2.

The processing unit 20 is a single component commonly indicated by "electronic control unit".

The control device 1 and the coil 2 are instead positioned in proximity of the engine head and are designed to tolerate the high working temperatures of the engine head.

The spark plug 3 is connected to the secondary winding 2-2 of the ignition coil 2. In particular, the spark plug 3 comprises a first electrode connected to the secondary winding 2-2 and comprises a second electrode connected to the ground reference voltage.

The spark plug 3 has the function of generating a spark at the ends of the electrodes thereof and the spark allows to burn the mixture air-fuel contained in a cylinder of the internal combustion engine.

The ignition system 15 is configured to operate according to three operating phases:

a charging phase, wherein it is performed the charge of energy into the primary winding 2-1, by means of the primary current I_pr flowing through the primary winding 2-1 with a increasing trend;

an energy transfer phase, wherein it is performed the transfer of energy from the primary winding 2-1 to the secondary winding 2-2, thus generating the spark on the electrodes of the spark plug 3 and thus burning the mixture air/fuel contained inside the cylinder of the internal combustion engine;

a measure phase of the ionization current, wherein it is performed a reading of the ionization current I_ion.

The measure phase of the ionization current further comprises a chemical phase and a subsequent thermal phase.

The control device 1 comprises;

a driving unit 5;

a high voltage switch 4;

a first switch 10-1;

a second switch 10-2;

a third switch 10-3;

a current measurement circuit 6;

In one embodiment, the control device 1 is a single component enclosed into a casing.

The ignition coil 2 has a primary winding 2-1, a secondary winding 2-2 and a magnetic core 2-3 for inductively coupling the primary winding 2-1 with the secondary winding 2-2.

The primary winding 2-1 comprises a first terminal connected to the first switch 10-1 and the second switch 10-2; the primary winding 2-1 further comprises a second terminal connected to the third switch 10-3 and to the high voltage switch 4 and adapted to generate a primary voltage V_pr.

Moreover, in the following a "voltage drop at the ends of the primary winding 2-1" will indicate the potential difference between the first terminal and the second terminal of the primary winding 2-1.

The secondary winding 2-2 is connected to the spark plug 3; in particular, the secondary winding 2-2 comprises a first terminal connected to a first electrode of the spark plug 3 and adapted to generate a secondary voltage V_sec and it comprises a second terminal connected towards a ground reference voltage through the current measuring circuit 6.

In the following "primary current" I_pr will be used to indicate the current flowing through the primary winding 2-1 and "secondary current" I_sec will be used to indicate the current flowing through the secondary winding 2-2 during the energy transfer phase from the primary winding 2-1 to the secondary winding 2-2.

The high voltage switch 4 is serially connected to the primary winding 2.1.

In particular, the high voltage switch 4 comprises a first terminal I4*i* connected to the second terminal of the primary winding 2.1 and connected to the third switch 10-3, it comprises a second terminal I4*o* connected to the ground reference voltage and it comprises a control terminal I4*c* connected to the driving unit 5.

The high voltage switch 4 is switchable between a closed position and an open position, as a function of the value of a control signal S_ctrl received on the control terminal I4*c*.

In one embodiment, the high voltage switch 4 is implemented with an IGBT type transistor (Insulated Gate Bipolar Transistor) having a collector terminal which coincides with the terminal I4*i*, having an emitter terminal that coincides with the terminal I4*o* and having a gate terminal that coincides with the terminal I4*c*; therefore in this case the primary voltage V_pr is equal to the voltage of the collector terminal of the IGBT transistor 4.

In particular the IGBT transistor 4 is configured to operate in the saturation zone when it is closed and in the cut off zone when it is open.

The IGBT transistor 4 is configured to operate with voltage values higher than 200 V.

Alternatively, the high voltage switch 4 can be implemented with a field effect transistor (MOSFET, JFET) or with two bipolar junction transistors (BJT).

The set of the second switch 10-2 and of the third switch 10-3 has the function of performing the connection of the terminals of the primary winding 2-1 towards a reference voltage V_ref (for example, the ground reference voltage) at the end of the energy transfer phase, as it will be explained in greater detail afterwards.

The first switch 10-1 has the further function of protecting the ignition system 15 in the presence of a current peak of a high value from the battery voltage V_batt towards the primary winding 2-1: in this case the driving unit 5 generates the first driving signal S1_drv to open the first switch 10-1.

The first switch 10-1, the second switch 10-2 and the third switch 10-3 are connected to the terminals of the primary winding 2-1.

In particular, the first switch 10-1 is serially connected to the primary winding 2.1.

The first switch 10-1 comprises a first terminal I1*i* adapted to receive a battery voltage V_batt, it comprises a second terminal I1*o* connected to the first terminal of the primary winding 2-1 and it comprises a driving terminal I1*c* adapted to receive a first driving signal $S1_drv$.

The first switch 10-1 is switchable between a closed position and an open position, as a function of the value of the first driving signal S1_drv.

In one embodiment, the first switch 10-1 is implemented with a p channel enhancement MOSFET transistor with saturation voltage Vds_sat (for example at 0.1V) and having a source terminal which coincides with the terminal I1*i*, having a drain terminal which coincides with the terminal I1*o* and having a gate terminal which coincides with the driving terminal I1*c*.

In particular, the MOSFET transistor 10-1 is configured to operate in the saturation zone when it is closed and in the cut off zone when it is open. When the MOSFET transistor 10-1 is configured to operate in the cut off zone, the voltage drop Vds1 between the drain terminal and the source terminal is a very small value (i.e. about zero).

The MOSFET transistor 10-1 is configured to operate with voltage values higher than 40 V.

Alternatively, the first switch 10-1 is implemented with a bipolar junction transistor (BJT) of a field effect transistor (JFET).

The second switch 10-2 comprises a first terminal I2*i* connected to the second terminal of the first switch 10-1 and connected to the first terminal of the primary winding 2-1, it comprises a second terminal I2*o* connected to the ground reference voltage and it comprises a driving terminal I2*c* adapted to receive a second driving signal S2_drv.

The second switch 10-2 is switchable between a closed position and an open position, as a function of the value of the second driving signal S2_drv.

In one embodiment, the second switch 10-2 is implemented with an n channel enhancement MOSFET transistor with saturation voltage Vds_sat (for example at 0.1V) and having a drain terminal which coincides with the terminal I2*i*, having a source terminal which coincides with the terminal I2*o* and a gate terminal which coincides with the driving terminal I2*c*.

In particular the MOSFET transistor 10-2 is configured to operate in the saturation zone when it is closed and in the cut off zone when it is open. When the MOSFET transistor 10-2 is configured to operate in the cut off zone, the voltage drop Vds2 between the drain terminal and the source terminal is a very small value (i.e. about zero).

The MOSFET transistor 10-2 is configured to operate with voltage values higher than 40 V.

Alternatively, the second switch 10-2 is implemented with a field effect transistor (JFET).

The third switch 10-3 comprises a first terminal I3*i* connected to the second terminal of the primary winding 2-1, it comprises a second terminal I3*o* connected to the ground reference voltage and it comprises a driving terminal I3*c* adapted to receive a third driving signal S3_drv.

The third switch 10-3 is switchable between a closed position and an open position, as a function of the value of the third driving signal S3_drv.

In one embodiment, the third switch 10-3 is implemented with an n channel enhancement MOSFET transistor with saturation voltage Vds_sat (for example at 0.1V) and having a drain terminal which coincides with the terminal I3*i*, having a source terminal which coincides with the terminal I3*o* and having a gate terminal which coincides with the driving terminal I3*c*.

In particular, the MOSFET transistor 10-3 is configured to operate in the saturation zone when it is closed and in the cut off zone when it is open. When the MOSFET transistor 10-3 is configured to operate in the cut off zone, the voltage drop Vds3 between the drain terminal and the source terminal is a very small value (i.e. about zero).

The MOSFET transistor 10-3 is configured to operate with voltage values higher than 500 V.

Alternatively, the third switch 10-3 is implemented with a field effect transistor (JFET).

It is observed that for the purposes of the explanation of the disclosure the second terminal of the second switch 10-2 and the third switch 10-3 are considered to be connected to the ground reference voltage, but more generally it is possible for the second terminal of the second switch 10-2 and for the third switch 10-3 to be connected to a reference voltage V_ref different from the battery voltage V_batt.

For example, if we suppose that the value of the battery voltage V_batt is 12 V, the value of the reference voltage V_ref is equal to a supply voltage VCC, which can be 8.2 V, 5 V or 3.3 V.

The current measuring circuit 6 has the function of measuring the value of the ionization current I_ion that flows during the measure phase of the ionization current.

The current measuring circuit 6 is connected between the second terminal of the secondary winding 2-2 and the ground reference voltage.

The driving unit 5 has the function of controlling the operation of the high voltage switch 4, of the first switch 10-1, of the second switch 10-2 and of the third switch 10-3.

The driving unit 5 is for example a micro-controller.

The driving unit 5 comprises an input terminal adapted to receive an ignition signal S_ac having a transition from one value to another (for example, a transition from a high to a low logic value, or viceversa) and it comprises a first output terminal adapted to generate, as a function of a value of the ignition signal S_ac, the control signal S_ctrl for driving the opening or closing of the high voltage switch 4.

In particular, the driving unit 5 is configured to receive the ignition signal S_ac having a first value (for example a logic high value) and to generate the control signal S_ctrl having a first value (for example, a voltage value higher than zero) for driving the closure of the high voltage switch 4.

Moreover, the driving unit 5 is configured to receive the ignition signal S_ac having a second value (for example a logic low value) and to generate the control signal S_ctrl having a second value (for example, a voltage value zero) for driving the opening of the high voltage switch 4, thus abruptly interrupting the primary current flow I_pr which flows through the primary winding 2-1: this causes a voltage pulse on the second terminal of the primary winding 2-1 having a short time length, typically with peak values of 200-450 V and having a time length of a few micro-seconds.

Consequently, the energy stored into the primary winding 2-1 is transferred on the secondary winding 2-2; in particular, a high-value voltage pulse is generated on the first terminal of the secondary winding 2-2, typically 15-50 kV, which is sufficient to initiate the spark between the electrodes of the spark plug 3.

Moreover, the driving unit 5 comprises a second output terminal adapted to generate the first driving signal S1_drv for driving the opening and closing of the first switch 10-1, it comprises a third output terminal adapted to generate the second driving signal S2_drv for driving the opening and closing of the second switch 10-2 and it comprises a fourth output terminal adapted to generate the third driving signal S3_drv for driving the opening and closing of the third switch 10-3.

In particular, the driving unit 5 is configured to generate the first driving signal S1_drv for opening the first switch 10-1, the second driving signal S2_drv for closing the second switch 10-2 and the third driving signal S3_drv for closing the third switch 10-3, in order to perform an appropriate connection of the terminals of the primary winding 2-1 towards the reference voltage V_ref (in particular, the ground reference voltage) at the end of the energy transfer phase, as will be explained in greater detail in the following.

Said appropriate connection of the terminals of the primary winding 2-1 allows to effectively and reliably reduce the inductance of the secondary winding 2-2 during the phase of reading the ionization current I_ion, because the equivalent impedance seen by the secondary winding 2-2 is determined by the substantially only resistive path towards the reference voltage V_ref at the primary winding 2-1: in this way the amplitude of the signal usable for the reading of the ionization current I_ion is improved.

Moreover, this appropriate connection of the terminals of the primary winding 2-1 allows to dissipate the residual energy on the secondary winding 2-2 at the end of the generation of the spark, as the residual energy is transformed into heat on the primary winding 2-1.

Moreover, said appropriate connection of the terminals of the primary winding 2-1 allows to shift upwards the frequency limit of the dynamic of the secondary winding 2-2.

Note that for the sake of simplicity no indication has been given of any driving circuits necessary for generating the appropriate voltage values of the first driving signal S1_drv, of the second driving signal S2_drv, of the third driving signal S3_drv and of the control signal S_ctrl; said driving circuits can be included for example internally to the driving unit 5.

In particular, in case wherein the first switch 10-1, the second switch 10-2 and the third switch 10-3 are implemented with respective MOSFET transistors, the first driving signal S1_drv, the second driving signal S2_drv and the third driving signal S3_drv are logic signals having a low logic value of 0 V and having a high logic value equal to the battery voltage V_batt=12 V.

Likewise, in case wherein the high voltage switch 4 is implemented with an IGBT transistor, the control signal V_ctrl is a logic signal having a low logic value of 0 V and having a high logic value equal to the supply voltage VCC (for example VCC=5 V).

Moreover, the driving unit 5 has the function of processing the value of the ionization current I_ion.

In particular, the driving unit 5 comprises a second input terminal adapted to receive the value of the ionization current I_ion.

In one embodiment, the driving unit 5 comprises a third input terminal adapted to receive the secondary current I_sec and is configured to detect, during the energy transfer phase, that the value of the secondary current had reached the value of a current threshold I_th and is configured to generate the third driving signal S3_drv for driving the closing of the third switch 10-3: this allows to instantaneously set to zero the value of the secondary current I_sec, because the residual energy on the secondary winding 2-2 is dissipated in the form of heat on the primary winding 2-1. Consequently, the oscillations at the end of the generation of the spark are reduced, and the time required for setting to zero the secondary current I_sec is reduced.

Further, the use of the current threshold I_th allows to precisely control the time instant at which to extinguish the residual energy on the secondary winding 2-2.

In one embodiment, the value of the current threshold I_th is a percentage of the maximum value Isec_max of the secondary current I_sec, wherein the value of said percentage is comprised between 0.1% and 5%.

It is observed that the current measuring circuit 6 can be integrated internally of the driving unit 5; in this case the second terminal of the secondary winding 2-2 is connected to the driving unit 5, which comprises an input terminal (in place of the second and third input terminal) adapted to receive the secondary current I_sec.

The processing unit 20 has the function of controlling the operation of the ignition coil 2, in order to generate the spark at the ends of the spark plug 3 at the correct instant.

In particular, the processing unit 20 comprises an output terminal adapted to generate the ignition signal S_ac having a transition from a first to a second value (for example, from a low to a high logic value) for terminating the first charging phase of the primary winding 2-1 and activating the second energy transfer phase from the primary winding 2-1 to the secondary winding 2-2, as will be explained in greater detail in the following with reference to FIGS. 1A-1B.

The driving unit 5, the processing unit 20 and the current measuring circuit 6 are supplied with a supply voltage VCC that is lower than or equal to the battery voltage V_batt (for example, VCC is equal to 3.3 V, 5 V or 8.2 V).

With reference to FIG. 1A, it shows schematically the electronic ignition system 15 during the charging phase of energy into the primary winding 2-1.

It can be observed that during the charging phase the switches 4 and 10-1 are closed, while the switches 10-2 and 10-3 are open: in this configuration a current flow I_chg flows (see FIG. 1A) from the battery voltage V_batt towards ground, crossing the switch 10-1, the first primary winding 2-1 and the switch 4; therefore the value of said current flow I_chg is equal to the value of the primary current I_pr flowing in the primary winding 2-1.

Figure 1B:
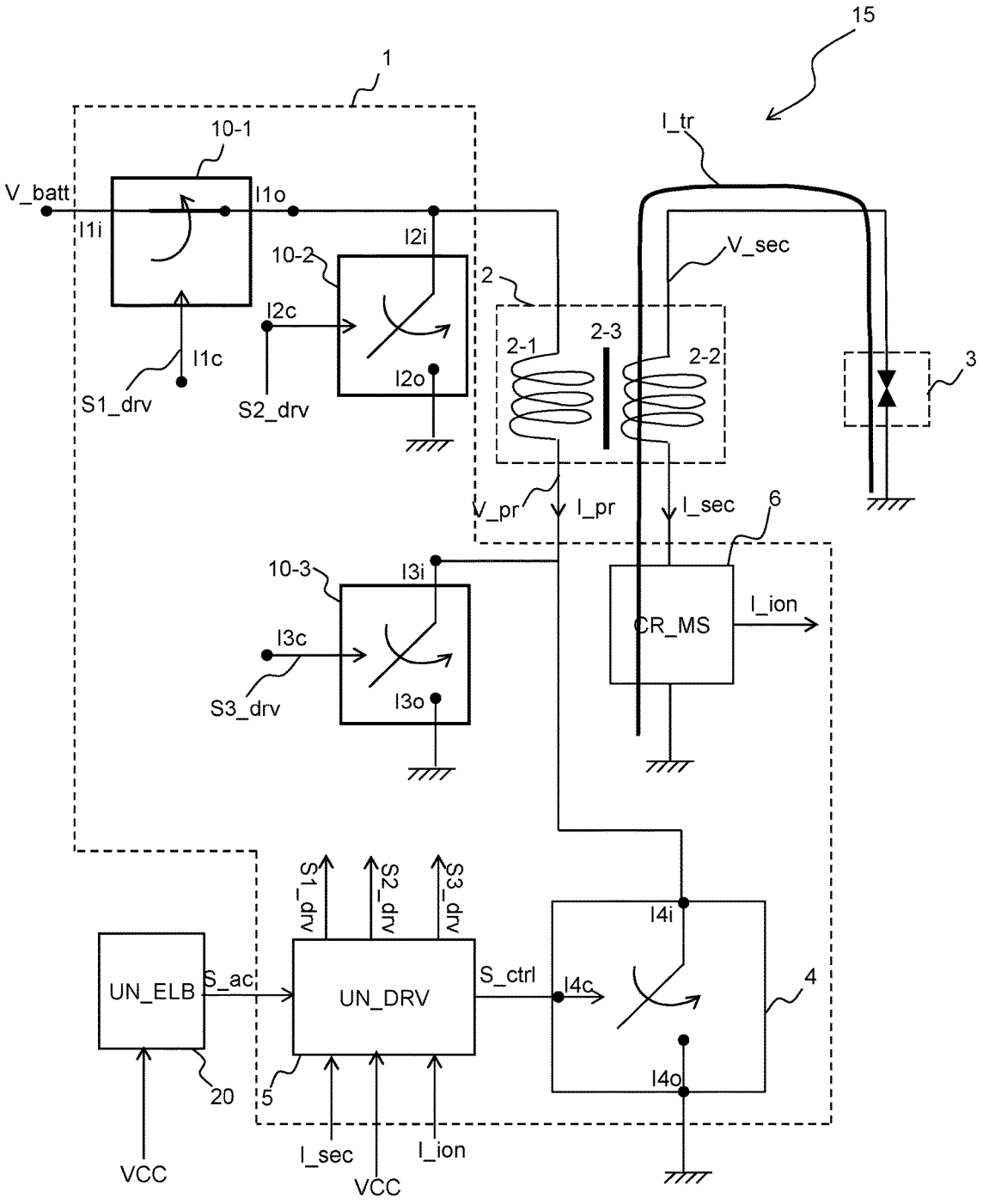
FIG. 1B schematically shows an electronic ignition system according to the embodiment of the disclosure, during an initial phase of transfer of energy from the primary winding to the secondary winding.

With reference to FIG. 1B, it shows the electronic ignition system 15 during an initial phase of energy transfer from the primary winding 2-1 to the secondary winding 2-2.

It can be observed that at the initial phase of energy transfer the switch 10-1 is closed, while switches 10-2, 10-3 and 4 are open: in this configuration a current flow I_tr flows (see FIG. 1B) through the spark plug 3, the secondary winding 2-2 and the current measuring circuit 6.

Figure 2A:
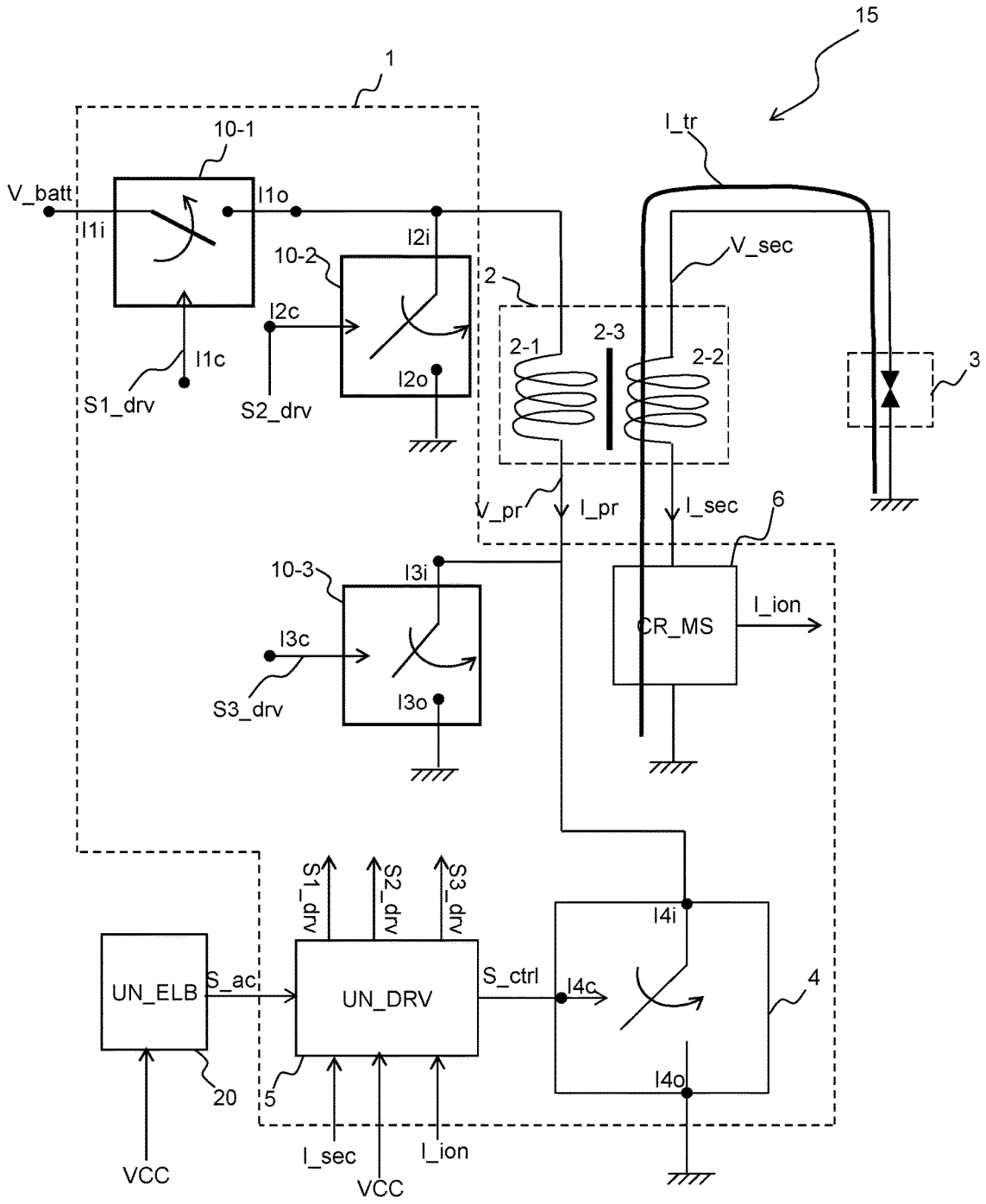
FIGS. 2A-2B schematically shows an electronic ignition system according to the embodiment of the disclosure, during two following configurations of the transfer phase of energy from the primary winding to the secondary winding.
Figure 2B:
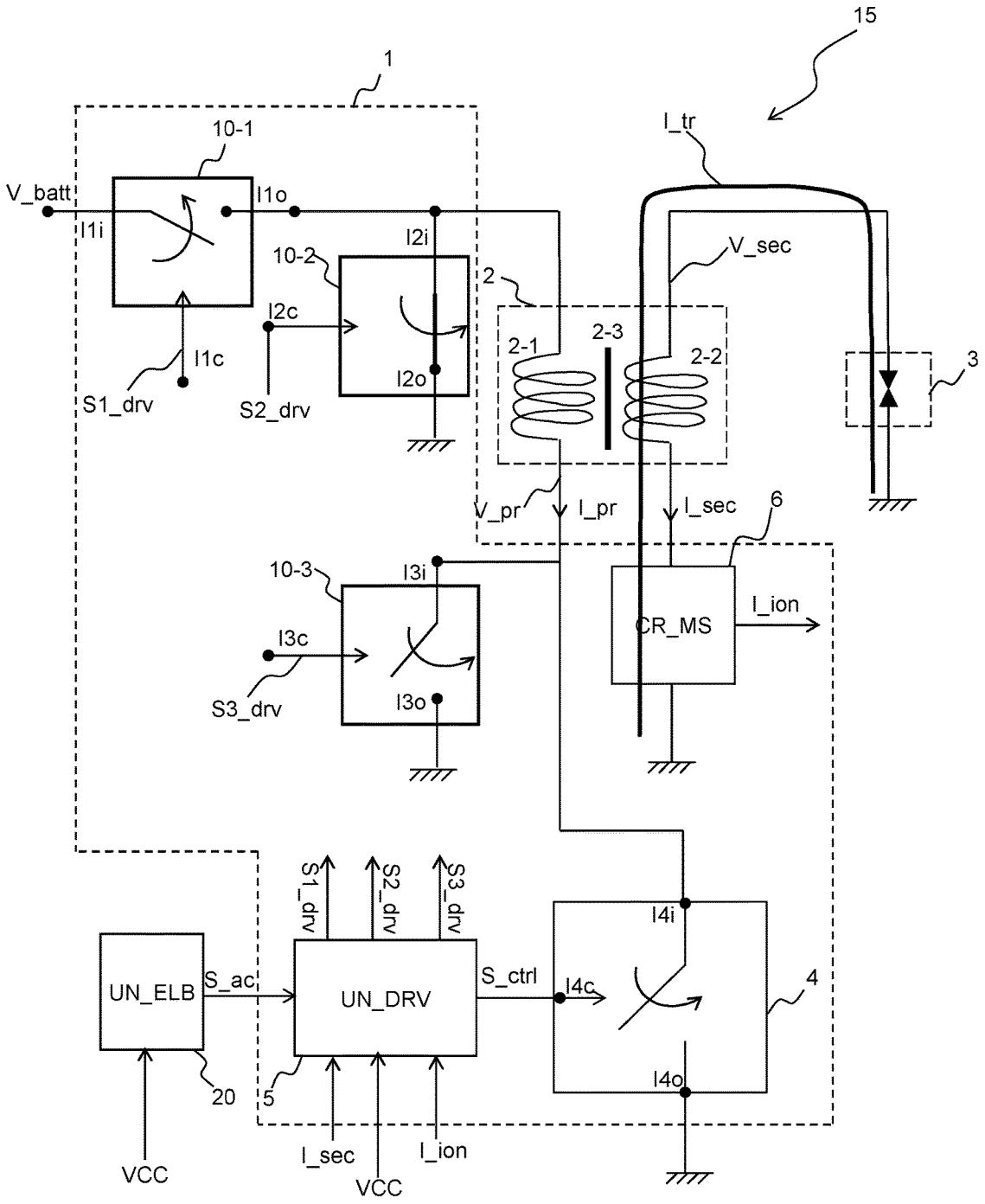

With reference to FIGS. 1B, 2A and 2B, they show the electronic ignition system 15 during three successive configurations of the energy transfer phase from the primary winding 2-1 to the secondary winding 2-2.

Figure 3:
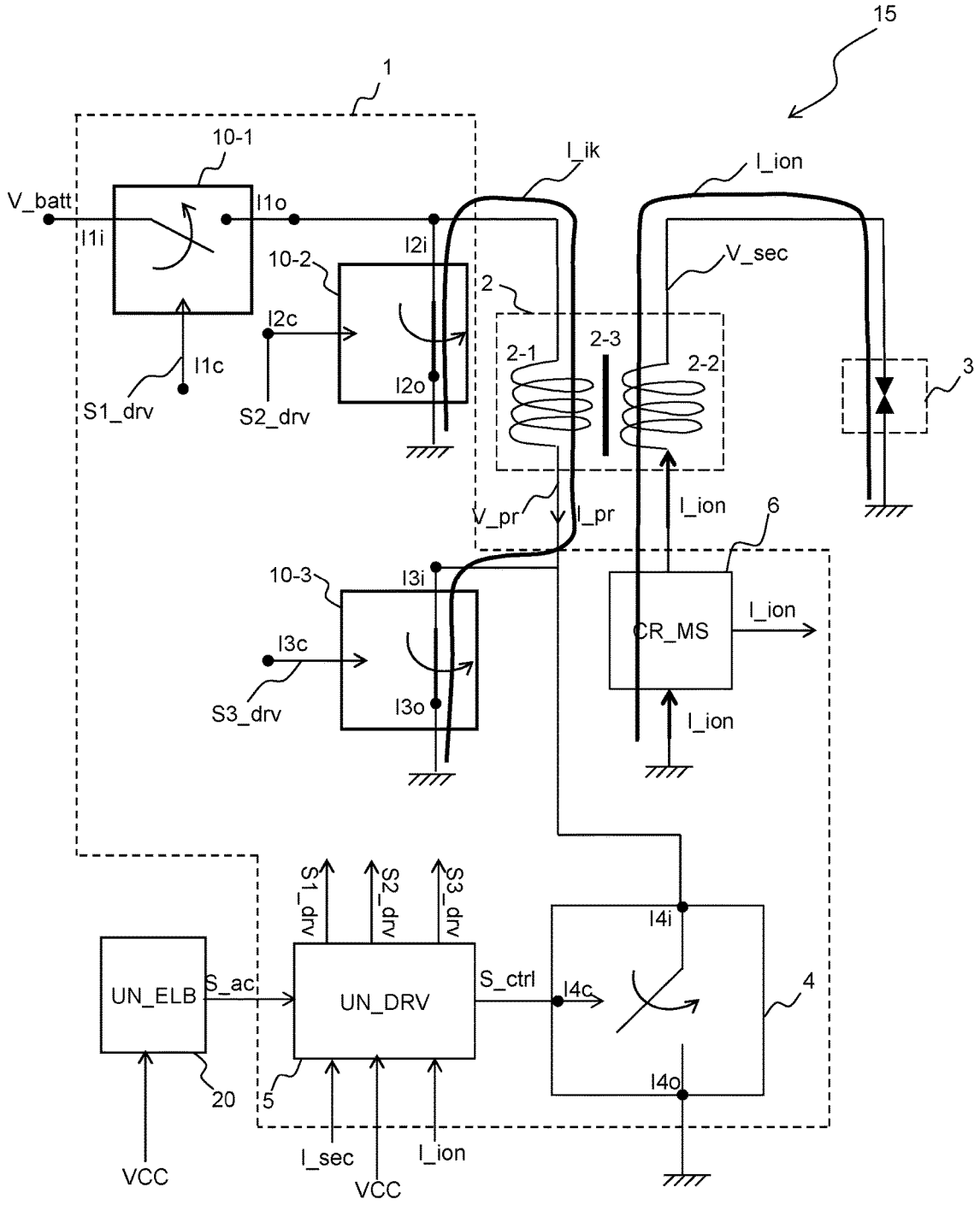
FIG. 3 schematically shows an electronic ignition system according to the embodiment of the disclosure, during the measure phase of the ionization current.

It can be observed that in the energy transfer phase three successive configurations are present:

- a first configuration wherein the switches 10-2, 10-3, and 4 are open (see FIG. 1B), while the switch 10-1 is closed: in this configuration a current flow I_tr flows (see FIG. 1B again) through the spark plug 3, the secondary winding 2-2 and the current measuring circuit 6;
- a second configuration wherein switches 10-1, 10-2, 10-3 and 4 are open (see FIG. 2A): in this configuration a current flow I_tr flows (see FIG. 2A again) through the spark plug 3, the secondary winding 2-2 and the current measuring circuit 6;
- a third configuration wherein switches 10-1, 10-3, and 4 are open while switch 10-2 is closed (see FIG. 2B): in this configuration a current flow I_tr continues to flow (see FIG. 2B again) through the spark plug 3, the secondary winding 2-2 and the current measuring circuit 6;

With reference to FIG. 3, it shows the electronic ignition system 15 during the measure phase of the ionization current I_ion.

It can be observed that switches 10-1 and 4 are open, while switches 10-2, 10-3 are closed: in this configuration a dissipating current flow I_ik flows with an oscillating trend having small values (for example in the order of 250-500 mA) through the switch 10-2, the primary winding 2-1 and the switch 10-3 (see FIG. 3) and further the ionization current I_ion flows through the current measuring circuit 6, the secondary winding 2-2 and the spark plug 3 (see FIG. 3 again).

The presence of the dissipating current flow I_ik through the primary winding 2-1 allows to instantaneously set to zero the value of the secondary current I_sec which flows through the secondary wiring 2-2, because the residual energy on the secondary winding 2-2 (see the current peak P1 in FIG. 4) is dissipated as heat on the primary winding 2-1: in this way the oscillations are reduced at the end of the generation of the spark and the time taken up for setting to zero the secondary current I_sec is reduced.

Figure 4:
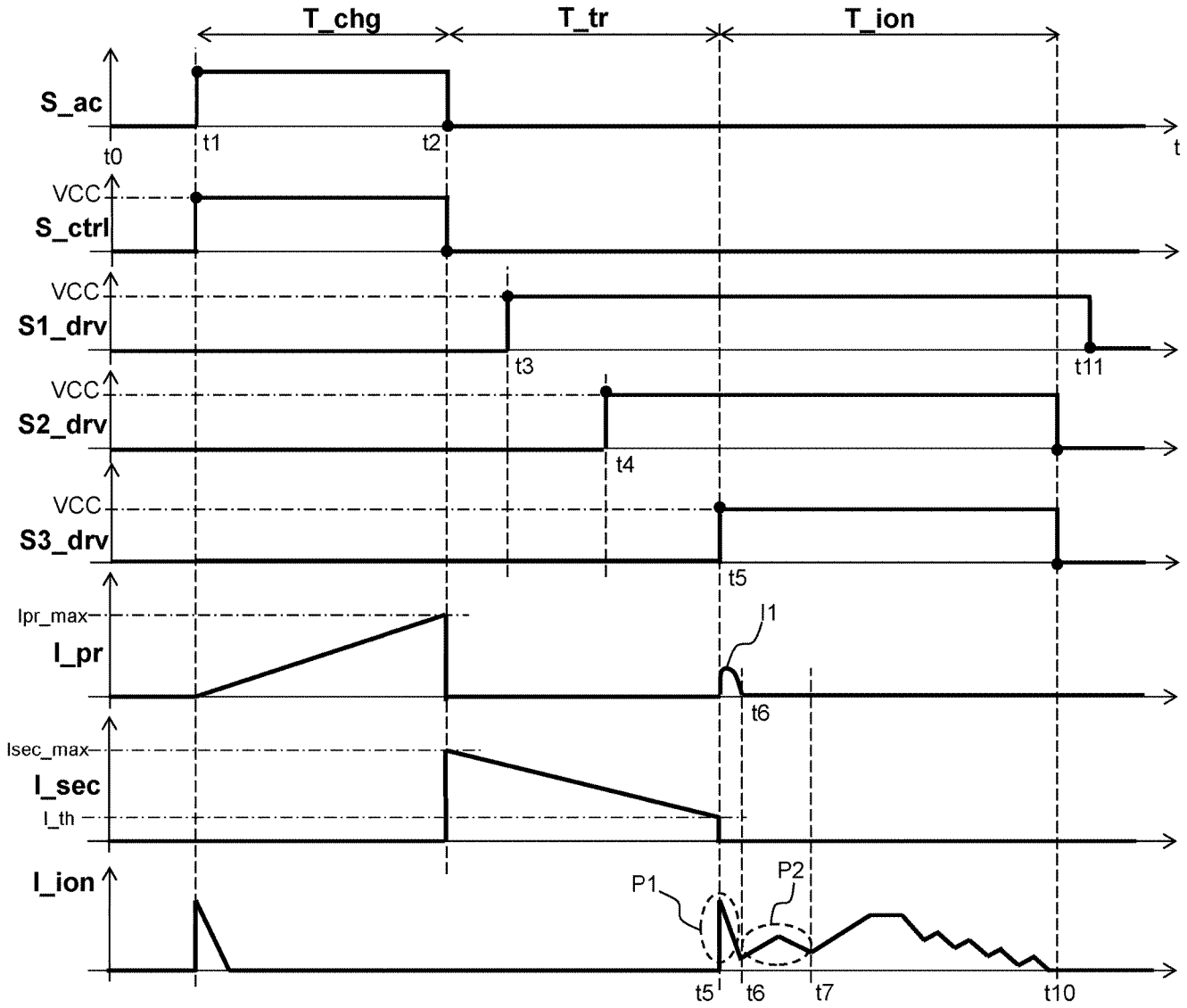
FIG. 4 schematically shows a possible trend of the signals generated in the electronic ignition system according to the embodiment of the disclosure, during an ignition cycle.

With reference to FIG. 4, it shows a possible trend of the ignition signal S_ac, of the control signal S_ctrl, of the first driving signal S1_drv, of the second driving signal S2_drv, of the third driving signal S3_drv, of the primary current I_pr, of the secondary current I_sec and of the ionization current I_ion according to the embodiment of the disclosure.

Note that for the purposes of the explanation of the disclosure FIG. 4 shows the signal of the secondary current I_sec separate from the signal of the ionization current I_ion, but in reality this is the current that flows through the secondary winding 2-2 in two different operating phases of the electronic ignition system 15, in the energy transfer phase having a time length T_tr and during the measure phase of the ionization current having time length T_ion, respectively.

Note that the signals represented in FIG. 4 are not in scale and that the content of the description takes precedence over the values derived from the signals.

FIG. 4 shows an ignition cycle comprised between t1 and t10, therefore the trend of the signals is repeated analogously in a second ignition cycle following the first and in the successive ignition cycles.

It is possible to observe the three operating phases of the electronic ignition system 15:

- the charging phase of the primary winding 2-1 has a time length T_chg and is comprised between instants t1 and t2;
- the energy transfer phase from the primary winding 2-1 to the secondary winding 2-2 has a time length T_tr and it is comprised between instants t2 and t5: at these instants the spark is generated at the ends of the electrodes of the spark plug 3;
- the measure phase of the ionization current has a time length T_ion and it is comprised between instants t5 and t10: at these instants it is performed a reading of the ionization current I_ion.

During the charging phase (instants between t1 and t2) switches 4 and 10-1 are closed, switches 10-2 and 10-3 are open, the primary current I_pr has a increasing trend from the null value to a maximum value Ipr_max, the value of the secondary current I_sec is substantially null and the ionization current I_ion is null.

During the energy transfer phase (time interval comprised between t2 and t5) the primary current I_pr is substantially null, the secondary current I_sec has at instant t2 a maximum value pulse Isec_max and then has a decreasing trend from the maximum value Isec_max to the substantially null value.

Further, during the energy transfer phase the switch 4 is open, the switch 10-1 switches at instant t3 from closed to open, then the switch 10-2 switches at instant t4 from open to closed, subsequently the switch 10-3 switches at instant t5 from open to closed.

In particular, it can be observed that the energy transfer phase comprises:

- a first time interval comprised between t2 and t3 wherein the switch 4 is open, the switch 10-1 is closed, the switches 10-2, 10-3 are open, which corresponds to the configuration of the switches shown in FIG. 1B;
- a second time interval comprised between instants t3 and t4 wherein the switches 10-1, 10-2, 10-3 and 4 are open, which corresponds to the first configuration of the switches shown in FIG. 2A;
- a third time interval comprised between instants t4 and t5 wherein the switches 10-1, 10-3 and 4 are open, while switch 10-2 is closed, which corresponds to the second configuration of the switches shown in FIG. 2B.

During the measure phase of the ionization current (time interval comprised between t5 and t10) switches 10-1 and 4 are open, switches 10-2, 10-3 are closed.

It can be observed that between instants t5 and t6 the primary current I_pr has an oscillating trend having very small values (for example in the order of 250-500 mA) and this is schematically shown in FIG. 4 by a pulse I1.

Following instant t6 the primary current I_pr has null values.

At instants comprised between t5 and t10 the secondary current I_sec is null.

Further, at instants comprised between t5 and t10 the ionization current I_ion flows through the secondary winding 2-2. In particular, the ionization current I_ion has a first current peak P1 at the instants comprised between t5 and t6, d subsequently at instant t6 the chemical phase begins wherein there is a second current peak P2 between instants t6 and t7, then at instant t7 the thermal phase begin, wherein it has an oscillating trend till reaching the null value.

Note that the first current peak P1 terminates at instant t6 wherein the pulse I1 of the primary current I_pr has reached the null value: in this way the residual energy present on the secondary winding 2-2 is dissipated at the end of the generation of the spark.

It is also possible to observe that when at instant t5 (wherein it occurs the transition from the energy transfer phase to the measure phase of the ionization current) the value of the secondary current I_sec has reached the value of the current threshold I_th, the secondary current I_sec undergoes a abrupt transition from a value slightly greater than zero to a null value: this allows to anticipate the reading of the ionization current I_ion by a time interval (typically comprised between 100 microseconds and 500 microseconds), which allows to read the value of the second peak P2 of the ionization current I_ion which occurs in the chemical phase of the measure phase of the ionization current. In this way further data can be detected representing the state of the combustion that has taken place during the energy transfer phase.

Further, the use of the current threshold I_th allows to precisely control the time instant t5 at which to set to zero the value of the secondary current I_sec and thus extinguish the residual energy on the secondary winding 2-2.

The operation of the ignition system 15 in an ignition cycle comprised between instants t1 and t10 will be described in the following, with reference also to FIGS. 1A-1B, 2A-2B, 3 and 4.

For the purposes of the explanation of the operation the following assumptions are considered:

- the reference voltage V_ref is equal to the ground reference voltage;
- battery voltage V_batt=12 V;
- supply voltage VCC=5 V;
- the first switch 10-1 is implemented with a p channel MOSFET transistor having a voltage drop Vds1 between the drain terminal and the source terminal when it is in the closed position, wherein the value of Vds1 is very small and can be approximated at 0 V.
- the second switch 10-2 and the third switch 10-3 are implemented with respective n channel MOSFETs;

the high voltage switch 4 is implemented with a IGBT transistor;

the control signal S_ctrl is a voltage signal;

the ignition signal S_ac and the control signal S_ctrl have logic values wherein the low logic value is 0 V and the high logic value is equal to the supply voltage VCC=5 V.

the first driving signal S1_drv, the second driving signal S2_drv and the third driving signal S3_drv have logic values wherein the low logic value is 0 V and the high logic value is equal to the battery voltage V_batt=12 V.

the turns ratio of the coil 2 is equal to N.

In the instants comprised between t0 and t1 (excluding t1) the processing unit 20 generates the ignition signal S_ac having a low logic value indicating that the spark cannot be generated on the spark plug 3.

The driving unit 5 receives the ignition signal Sac having the low logic value and generates, on the control terminal of the IGBT transistor 4, the control voltage signal S_ctrl having a low logic value which maintains the IGBT transistor 4 open.

Moreover, the driving unit 5 generates the first driving signal S1_drv having the low logic value that maintains the first switch 10-1 closed, generates the second driving signal S2_drv having the low logic value which maintains the second switch 10-2 open and generates the third driving signal S3_drv having the low logic value which maintains the third switch 10-3 open.

Since the IGBT transistor 4 is open, no current flows through the primary winding 2-1 and thus the primary current I_pr has a null value. Consequently, the primary voltage V_pr has a value equal to V_batt−Vds1=12 V−Vds1, the voltage drop at the ends of the primary winding 2-1 is null and the secondary current I_sec has a null value.

At instant t1 the processing unit 20 generates the ignition signal S_ac having a transition from the low logic value to the high logic value (equal to the supply voltage VCC) which indicates the start of the ignition phase.

The driving unit 5 receives the ignition signal S_ac equal to the high logic value and generates, on the control terminal of the IGBT transistor 4, the control voltage signal S_ctrl having a value equal to the high logic value which closes the IGBT transistor 4 (see the configuration of FIG. 1A).

Moreover, the driving unit 5 generates the first driving signal S1_drv having the low logic value which maintains the first switch 10-1 closed, generates the second driving signal S2_drv having the low logic value which maintains the second switch 10-2 open and generates the third driving signal S3_drv having the low logic value which maintains the third switch 10-3 open (see the configuration of FIG. 1A again).

Since the first switch 10-1 and the IGBT transistor 4 are closed, it starts the energy charging phase in the primary winding 2-1 during which the primary current I_pr begins to flow from the battery voltage V_batt towards the ground reference voltage, crossing the first switch 10-1, the primary winding 2-1 and the IGBT transistor 4.

The primary voltage V_pr has a transition from the value V_batt−Vds1 to the saturation voltage value Vds_sat, the voltage of the first terminal of the primary winding 2.1 stays equal to V_batt−Vds1 and thus the voltage drop at the ends of the primary winding 2-1 has a transition from the null value to value V_batt−Vds1−Vds_sat; moreover, the secondary voltage V_sec has a transition from the null value to value N*(V_batt−Vds1−Vds_sat).

The operation at instants comprised between t1 and t2 (excluding t2) is similar to the operation described at instant t1, with the following differences.

In particular:

the control voltage signal S_ctrl maintains the value equal to the high logic value (equal to the supply voltage VCC), which maintains the IGBT transistor 4 closed;

the first driving signal S1_drv maintains the low logic value, which maintains the first switch 10-1 closed;

the second driving signal S2_drv and the third driving signal S3_drv maintain the low logic value, which maintain the second switch 10-2 and the third switch 10-3 open;

the primary current I_pr flowing through the primary winding 2-1 has a increasing trend, which continues to charge energy into the primary winding 2-1;

the voltage of the first terminal of the primary winding 2-1 remains equal to V_batt−Vds1;

the primary voltage V_pr has a increasing trend as the primary current I_pr increases;

the voltage drop at the ends of the primary winding 2-1 has a decreasing trend;

the secondary voltage V_sec has a decreasing trend from the value N*(V_batt−Vds1) to the value N*(V_batt−Vds1−Vds_sat), with a trend that follows that of the primary voltage V_pr less the value of the turns ratio N.

At instant t2 the processing unit 20 generates the ignition signal S_ac having a transition from the high logic value (equal to the supply voltage VCC) to the low logic value which indicates the end of the ignition phase and the start of the energy transfer phase from the primary winding 2-1 to the secondary winding 2-2.

The driving unit 5 receives the ignition signal S_ac equal to the low logic value and generates, on the control terminal of the IGBT transistor 4, the control voltage signal S_ctrl having a logic low value which opens the IGBT transistor 4 (see the configuration of FIG. 1B).

Moreover, the driving unit 5 generates the first driving signal S1_drv having the logic low value which maintains the first switch 10-1 closed, generates the second driving signal S2_drv having the low logic value which maintains the second switch 10-2 open and generates the third driving signal S3_drv having the logic low value which maintains the third switch 10-3 open (see the configuration of FIG. 1B again).

Since the IGBT transistor 4 is opened, the current flow I_chg from the battery voltage V_batt towards ground through the primary winding 2-1 is abruptly interrupted and thus the energy (previously stored into the primary winding 2-1) starts being transferred on the secondary winding 2-2.

Consequently, the primary voltage V_pr has a pulse of a high value (typically 200-450 V) and short time length (typically a few microseconds), the primary current I_pr abruptly decreases from the maximum value Ipr_max to the null value, the secondary current I_sec has a pulse of value Isec_max and the secondary voltage V_sec has a pulse of a very high value (for example 30 KV), which initiates the spark at the ends of the electrodes of the spark plug 3.

Note that for the sake of simplicity the primary current I_pr has been assumed to have an instantaneous transition from the maximum value Ipr_max to the null value at time instant t2, but in reality said transition occurs in a time interval which lasts for example between 2 and 15 microseconds: in this case the absolute value of the secondary voltage V_sec has a increasing trend with a high tilt towards the maximum value and the spark occurs when the absolute value of the secondary voltage V_sec has reached the maximum value (and thus when then primary current I_pr has reached the null value).

In the instants comprised between t2 and t3 (excluding t3) the spark between the electrodes of the spark plug 3 is maintained and thus the combustion of the mixture air-fuel continues.

The operation is similar to what is described at instant t2, thus the positions of the IGBT transistor 4, of the first switch 10-1, of the second switch 10-2 and of the third switch 10-3 are the same as those indicated at instant t2.

Consequently, the value of the primary current I_pr is maintained equal to zero, while the secondary current has a decreasing trend starting from the maximum value Isec-_max.

At instant t3 the spark between the electrodes of the spark plug 3 is maintained and thus the combustion of the mixture air-fuel continues.

The processing unit 20 continues to generate the ignition signal S_ac having the low logic value and the driving unit 5 continues to generate the control voltage signal S_ctrl having the low logic value which maintains the IGBT transistor 4 open (see the configuration of FIG. 2A).

Moreover, the driving unit 5 generates the first driving signal S1_*drv* having a transition from the low logic value to the high logic value which opens the first switch 10-1, generates the second driving signal S2_drv having the low logic value which maintains the second switch 10-2 open and generates the third driving signal S3_drv having the low logic value which maintains the third switch 10-3 open (see again the configuration of FIG. 2A).

It has to be observed that first the IGBT transistor 4 is opened (instant t2) and then (instant t3) the first switch 10-1 is opened, that is the control signal S_ctrl and the first driving signal S1_drv are not switched at the same instant: in this way it is avoided that it is erroneously opened (due to different opening delays) first the first switch 10-1 and then the IGBT transistor 4.

Since the IGBT transistor 4 and the first switch 10-1 are open, the primary current I_pr maintains the null value.

Moreover, the secondary current I_sec continues to have a decreasing trend.

In the instants comprised between t3 and t4 (excluding t4) the spark between the electrodes of the spark plug 3 is maintained and thus the combustion of the mixture air-fuel continues.

The operation is similar to what is described at instant t3, thus the positions of the IGBT transistor 4, of the first switch 10-1, of the second switch 10-2 and of the third switch 10-3 are the same as those indicated at instant t3.

Consequently, the primary current I_pr maintains a null value and the secondary current I_sec continues to have a decreasing trend.

At instant t4 the spark between the electrodes of the spark plug 3 is maintained and thus the combustion of the mixture air-fuel continues.

The processing unit 20 continues to generate the ignition signal S_ac having the low logic value and the driving unit 5 continues to generate the control voltage signal S_ctrl having the low logic value which maintains the IGBT transistor 4 open (see the configuration of FIG. 2B).

Moreover, the driving unit 5 generates the second driving signal S2_drv having a transition from the low logic value to the high logic value which closes the second switch 10-2, continues to generate the first driving signal S1_drv having the low logic value which maintains the first switch 10-1 open and continues to generate the third driving signal S3_drv having the low logic value which maintains the third switch 10-3 open (see the configuration of FIG. 2B again).

Since the IGBT transistor 4, the first switch 10-1 and the third switch 10-3 are open, the primary current I_pr maintains the null value.

Moreover, the secondary current I_sec continues to have a decreasing trend.

In the instants comprised between t4 and t5 (excluding t5) the spark between the electrodes of the spark plug 3 is maintained and thus the combustion of the mixture air-fuel continues.

The operation is similar to what is described at instant t4, thus the positions of the IGBT transistor 4, of the first switch 10-1, of the second switch 10-2 and of the third switch 10-3 are the same as those indicated at instant t4.

Consequently, the primary current I_pr maintains a null value and the secondary current I_sec continues to have a decreasing trend.

At instant t5 the driving unit 5 detects that the secondary current I_sec has reached the value of the current threshold I_th and generates the third driving signal S3_drv equal to the high logic value which closes the third switch 10-3 (see FIG. 3).

Note that as the second switch 10-2 and the third switch 10-3 can have different closure delays, first the second switch 10-2 is closed (instant t4) and then the third switch 10-3 (instant t5), so as to optimise the driving.

Moreover, the driving unit continues to generate the first driving signal S1_drv equal to the high logic value that maintains the first switch 10-1 open, continues to generate the second driving signal S2_drv equal to the high logic value which maintains the second switch 10-2 closed and continues to generate the control signal S_ctrl equal to the low logic value which maintains the IGBT transistor 4 open (see FIG. 3 again).

Since the first switch 10-1 is open, the second switch 10-2 and the third switch 10-3 are closed and the IGBT transistor 4 is open, a flow of dissipating current I_ik having small values (for example of the order of 250-500 mA) begins to flow through the switch 10-2, the primary winding 2-1 and the switch 10-3: this flow of dissipating current I_ik flowing through the primary winding 2-1 (see pulse I1 in FIG. 4) instantaneously sets to zero the value of the secondary current I_sec which flows through the secondary winding 2-2, because the residual energy on the secondary winding 2-2 (see the first peak P1 in FIG. 4) is transformed into heat on the primary winding 2-1.

At instant t6 it is possible to begin the measurement of the ionization current, because the value of the secondary current I_sec has a null value and thus it is possible to measure the contribution of the current generated at the electrodes of the spark plug following the ions generated during the combustion of the mixture air-fuel.

Therefore at instant t6 the current measurement circuit 6 measures the intensity of the current I_ion flowing through the secondary winding 2-2.

The driving unit 5 receives the value of the ionization current I_ion and generates, as a function thereof, parameters representing the combustion process of the mixture air-fuel which occurred in the instants comprised between t2 and t5.

In particular, in the instants comprised between t6 and t7 it is measured the second peak P2 of the value of the ionization current I_ion representing the current generated by the ions produced during the chemical phase of the measure phase of the ionization current.

Subsequently, in the instants comprised between t7 and t10 it is measured the intensity of the ionization current I_ion representing the current generated by the ions produced during the thermal phase of the measure phase of the ionization current.

For example, the trend of the ionization current I_ion during the thermal phase is indicative of the trend of the value of the pressure internally of the cylinder wherein the combustion of the mixture air-fuel has occurred and thus it allows to detect the presence of "knock" vibrations.

At instant t10 the first ignition cycle terminates and the second ignition cycle begins.

At the start of the second ignition cycle (in particular, at instant t11) the driving unit 5 generates the first driving signal S1_drv having a transition from the high to the low logic value which closes the first switch 10-1: in this way the ignition system 15 is ready to restart the energy charging phase in the primary winding 2-1, by means of closing the IGBT transistor 4.

It is observed that for the purposes of explaining the disclosure a case has been considered wherein the secondary winding 2-2 has the first terminal connected to the spark plug 3 and the second terminal connected towards the ground through the current measuring circuit 6; alternatively, the disclosure is applicable also in the case wherein the secondary winding 2-2 has the first terminal connected to the battery voltage V_batt and the second terminal connected to the spark plug 3 through the current measuring circuit 6 and further the spark plug 3 has the other electrode connected towards the ground reference voltage.

According to a variant of the disclosure, the electronic ignition system 15 comprises:

- a plurality of spark plugs, each one mounted on a cylinder of the internal combustion engine;
- a respective plurality of ignition coils, each coil connected to a respective spark plug out of the plurality of plugs;
- a respective plurality of high-voltage switches, each switch being serially connected to the primary winding of the respective coil of the plurality of coils.

In this case the ignition system 1 comprises the first switch 10-1, the second switch 10-2 and the third switch 10-3, which are connected to the plurality of primary windings of the plurality of ignition coils.

In other words, it is possible to use a single first switch 10-1, a single second switch 10-2 and a single third switch 10-3, for performing the connection towards the reference voltage V_ref of the terminals of all the primary windings of the plurality of coils.

In the variant of the disclosure the ionization current I_ion shown in FIG. 4 is relative to each cylinder of the plurality of cylinders of the internal combustion engine.

One embodiment of the present disclosure is an electronic device 1 to control a coil 2. The electronic control device 1 comprises:

- a high voltage switch 4 serially connected to the primary winding 2-1 of the coil and having a control terminal I4*c* carrying a signal S_ctrl to control the opening or closing of the high voltage switch;
- a first switch 10-1 interposed between a battery voltage V_batt and the first terminal of the primary winding and having a first driving terminal I1*c* carrying a first driving signal S1_drv to control the opening or closing of the first switch;
- a second switch 10-2 interposed between the first terminal of the primary winding and a reference voltage and having a second driving terminal I2*c* carrying a second driving signal S2_drv to control the opening or closing of the second switch;
- a third switch 10-3 interposed between the second terminal of the primary winding and said reference voltage and having a third driving terminal I3*c* carrying a third driving signal S3_drv to control the opening or closing of the third switch;
- a driving unit 5 configured, during a charging phase of energy into the primary winding, to:
  - generate the control signal S_ctrl having a value to close the high voltage switch 4;
  - generate the first driving signal S1_drv having a value to close the first switch 10-1;
  - generate the second driving signal S2_drv having a value to open the second switch 10-2;
  - generate the third driving signal S3_drv having a value to open the third switch 10-3;

wherein the driving unit is further configured, during a transfer phase of energy from the primary winding to the secondary winding of the coil, to:

- generate the control signal S_ctrl having a value to open the high voltage switch 4;
- generate the first driving signal S1_drv having a value to open the first switch 10-1;

wherein the driving unit 5 is further configured, during a measure phase of a ionization current subsequent to the energy transfer phase, to:

- generate the control signal having a value to open the high voltage switch 4;
- generate the first driving signal having a value to open the first switch 10-1;
- generate the second driving signal having a value to close the second switch 10-2;
- generate the third driving signal having a value to close the third switch 10-3.

In one embodiment, the value of the reference voltage is a ground reference voltage.

In one embodiment, the driving unit 5 of the electronic control device 1 is further configured, at the end of the energy transfer phase, to detect that the value of the secondary current I_sec flowing through the secondary winding 2-2 is equal to the value of a current threshold I_th, and it is configured to generate therefrom the third driving signal S3_drv having a value to close the third switch 10-3.

One embodiment of the present disclosure is a method for controlling the electronic ignition of an internal combustion engine.

The method comprises the steps of:

a) providing a coil 2 having a primary winding 2-1 and a secondary winding 2-2 connected to a spark plug 3 and providing a high voltage switch 4 serially connected to the primary winding 2-1;

b) interposing a first switch 10-1 between a battery voltage V_batt and a first terminal of the primary winding 2-1;

c) interposing a second switch 10-2 between the first terminal of the primary winding and a reference voltage;

d) interposing a third switch 10-3 between a second terminal of the primary winding and said reference voltage;

e) during a charging phase of energy into the primary winding 2-1, closing the high voltage switch 4 and the first switch 10-1 and opening the second switch 10-2 and the third switch 10-3;

f) during a transfer phase of energy from the primary winding 2-1 to the secondary winding 2-2, opening the high voltage switch 4, opening the first switch 10-1 and closing the second switch 10-2;

g) during a measure phase of the ionization current, closing the third switch 10-3.

The invention claimed is:

1. An electronic ignition system for an internal combustion engine, the electronic ignition system comprising:

a coil that includes:

a primary winding having a first terminal and a second terminal;

a secondary winding connected to a spark plug;

a high voltage switch serially connected to the primary winding and having a control terminal carrying a signal to control an opening or a closing of the high voltage switch;

a first switch interposed between a battery voltage and the first terminal of the primary winding and having a first driving terminal carrying a first driving signal to control an opening or a closing of the first switch;

a second switch interposed between the first terminal of the primary winding and a reference voltage and having a second driving terminal carrying a second driving signal to control an opening or a closing of the second switch;

a third switch interposed between the second terminal of the primary winding and said reference voltage and having a third driving terminal carrying a third driving signal to control an opening or a closing of the third switch;

a driving unit configured, during a charging phase of energy into the primary winding, to:

generate the control signal having a value to close the high voltage switch;

generate the first driving signal having a value to close the first switch;

generate the second driving signal having a value to open the second switch;

generate the third driving signal having a value to open the third switch;

wherein the driving unit is further configured, during a transfer phase of energy from the primary winding to the secondary winding, to:

generate the control signal having a value to open the high voltage switch;

generate the first driving signal having a value to open the first switch;

wherein the driving unit is further configured, during a measure phase of an ionization current subsequent to the energy transfer phase, to:

generate the control signal having a value to open the high voltage switch;

generate the first driving signal having a value to open the first switch;

generate the second driving signal having a value to close the second switch;

generate the third driving signal having a value to close the third switch.

2. The electronic ignition system according to claim 1, wherein the value of the reference voltage is one of the following:

a ground reference voltage;

a supply voltage smaller than the battery voltage.

3. The electronic ignition system according to claim 1, wherein the driving unit is further configured, at the end of the transfer phase of energy, to:

detect that a value of a secondary current flowing through the secondary winding is equal to a value of a current threshold;

generate therefrom the third driving signal having a value to close the third switch.

4. The electronic ignition system according to claim 1, wherein the driving unit is further configured:

during a first time interval of the transfer phase of energy, to:

generate the control signal having a value to open the high voltage switch;

generate the first driving signal having a value to close the first switch;

generate the second driving signal having a value to open the second switch;

generate the third driving signal having a value to open the third switch;

during a second time interval subsequent to the first time interval of the transfer phase of energy, to:

generate the control signal having a value to open the high voltage switch;

generate the first driving signal having a value to open the first switch;

generate the second driving signal having a value to open the second switch;

generate the third driving signal having a value to open the third switch;

during a third time interval subsequent to the second time interval of the transfer phase of energy, to:

generate the control signal having a value to open the high voltage switch;

generate the first driving signal having a value to open the first switch;

generate the second driving signal having a value to close the second switch;

generate the third driving signal having a value to open the third switch.

5. The electronic ignition system according to claim 1, wherein the value of the current threshold is a percentage of a maximum value of the current flowing through the secondary winding, wherein the value of the percentage is between 0.1% and 5%.

6. The electronic ignition system according to claim 1, further comprising:

a measurement circuit configured to measure, during said measure phase of the ionization current, a value of the ionization current flowing through the secondary winding, wherein said ionization current is generated by ions produced during a combustion process of an air-fuel mixture that occurs because of a spark generated by the spark plug in the transfer phase of energy.

7. The electronic ignition system according to claim 1, wherein:

the first switch comprises a p channel MOSFET transistor, wherein a gate terminal carries the first driving signal;

the second and the third switches comprise n channel MOSFET transistors having respective gate terminals which carry, respectively, the second and the third driving signals;

the high voltage switch comprises an IGBT transistor having a gate terminal which is the control terminal.

8. The electronic ignition system according to claim 1, further comprising:

a processing unit configured to generate an ignition signal having a first value for indicating a beginning of the primary winding charging phase and having a second value for indicating a beginning of the transfer phase of energy from the primary winding to the secondary winding, wherein the driving unit is further configured to receive the ignition signal and generate, as a function thereof, the control signal and the first, second and third driving signals, and wherein the high voltage switch, the first switch, the second switch, the third switch and the driving unit are enclosed into a single component.

9. An electronic device to control a coil, the electronic device comprising:

a high voltage switch serially connected to a primary winding of the coil and having a control terminal carrying a signal to control an opening or a closing of the high voltage switch;

a first switch interposed between a battery voltage and a first terminal of the primary winding and having a first driving terminal carrying a first driving signal to control an opening or a closing of the first switch;

a second switch interposed between the first terminal of the primary winding and a reference voltage and having a second driving terminal carrying a second driving signal to control an opening or a closing of the second switch;

a third switch interposed between a second terminal of the primary winding and said reference voltage and having a third driving terminal carrying a third driving signal to control an opening or a closing of the third switch;

a driving unit configured, during a charging phase of energy into the primary coil, to:

generate the control signal having a value to close the high voltage switch;

generate the first driving signal having a value to close the first switch;

generate the second driving signal having a value to open the second switch;

generate the third driving signal having a value to open the third switch;

wherein the driving unit is further configured, during a transfer phase of energy from the primary winding to the secondary winding of the coil, to:

generate the control signal having a value to open the high voltage switch;

generate the first driving signal having a value to open the first switch;

wherein the driving unit is further configured, during a measure phase of an ionization current subsequent to the transfer phase of energy, to:

generate the control signal having a value to open the high voltage switch;

generate the first driving signal having a value to open the first switch;

generate the second driving signal having a value to close the second switch;

generate the third driving signal having a value to close the third switch.

10. A method for controlling the electronic ignition of an internal combustion engine, the method comprising:

a) providing a coil having a primary winding and a secondary winding connected to a spark plug and providing a high voltage switch serially connected to the primary winding;

b) interposing a first switch between a battery voltage and a first terminal of the primary winding;

c) interposing a second switch between the first terminal of the primary winding and a reference voltage;

d) interposing a third switch between a second terminal of the primary winding and said reference voltage;

e) during a charging phase of energy into the primary winding, closing the high voltage switch and the first switch and opening the second and third switches;

f) during a transfer phase of energy from the primary winding to the secondary winding, opening the high voltage switch, opening the first switch and closing the second switch; and g) during a measure phase of the ionization current, closing the third switch.

11. A computer program product comprising software code portions adapted to perform the steps e), f), and g) of the method according to claim 10, when said program is run on at least one computer.

* * * * *